US005766047A

United States Patent [19]

Alexander, Jr. et al.

[11] Patent Number: 5,766,047

[45] Date of Patent: Jun. 16, 1998

[54] TWIN PROPELLER MARINE PROPULSION UNIT

[75] Inventors: Charles F. Alexander, Jr., Austin, Tex.; Daniel F. McCormick, Oshkosh, Wis.

[73] Assignee: Brunswick Corporation, Lake Forest, Ill.

[21] Appl. No.: 719,633

[22] Filed: Sep. 25, 1996

[51] Int. Cl.[6] ..... B63H 5/10

[52] U.S. Cl. ..... 440/81; 440/75; 440/76; 416/129 A

[58] Field of Search ..... 440/75, 81, 88, 440/79, 76, 78; 416/129 R, 129 A, 130; 192/51, 48.91

[56] References Cited

U.S. PATENT DOCUMENTS

| | | | |
|---|---|---|---|
| 2,672,115 | 3/1954 | Conover . | |
| 2,989,022 | 6/1961 | Lundquist . | |
| 3,478,620 | 11/1969 | Shimanckas | 440/75 |
| 4,793,773 | 12/1988 | Kinouchi et al. . | |
| 5,230,644 | 7/1993 | Meisenburg et al. | 440/80 |
| 5,249,995 | 10/1993 | Meisenburg et al. | 440/81 |
| 5,352,141 | 10/1994 | Shields et al. | 440/80 |
| 5,366,398 | 11/1994 | Meisenburg et al. | 440/75 |
| 5,376,031 | 12/1994 | Meisenburg et al. | 440/76 |
| 5,403,218 | 4/1995 | Onoue et al. | 440/75 |
| 5,449,306 | 9/1995 | Nakayasu et al. | 440/75 |
| 5,514,014 | 5/1996 | Ogino et al. | 440/75 |
| 5,520,559 | 5/1996 | Nakqayasu et al. | 440/75 |
| 5,522,702 | 6/1996 | Okamoto | 416/93 A |
| 5,529,520 | 6/1996 | Iwashita et al. | 440/66 |

*Primary Examiner*—Jesus D. Sotelo
*Attorney, Agent, or Firm*—Andrus, Sceales, Starke & Sawall

[57] ABSTRACT

A twin propeller marine propulsion unit for a watercraft. A vertical drive shaft operably connected to the engine is journaled for rotation in a lower gear case and carries a beveled pinion that drives a pair of coaxial bevel gears. An inner propeller shaft and an outer propeller shaft are mounted concentrically in the lower torpedo-shaped section of the gear case and each propeller shaft carries a propeller. To provide forward movement for the watercraft, a sliding clutch, is moved in one direction to operably connect a first of the bevel gears with the inner propeller shaft to thereby drive the rear propeller. When the engine speed reaches a pre-selected elevated value, a hydraulically operated multi-disc clutch is actuated to operably connect the second of the bevel gears to the outer propeller shaft, to thereby drive the second propeller in the opposite direction. With this construction only a single propeller is driven at low engine speeds and the second propeller is driven when the engine speed reaches the pre-selected value.

31 Claims, 4 Drawing Sheets

FIG. 3
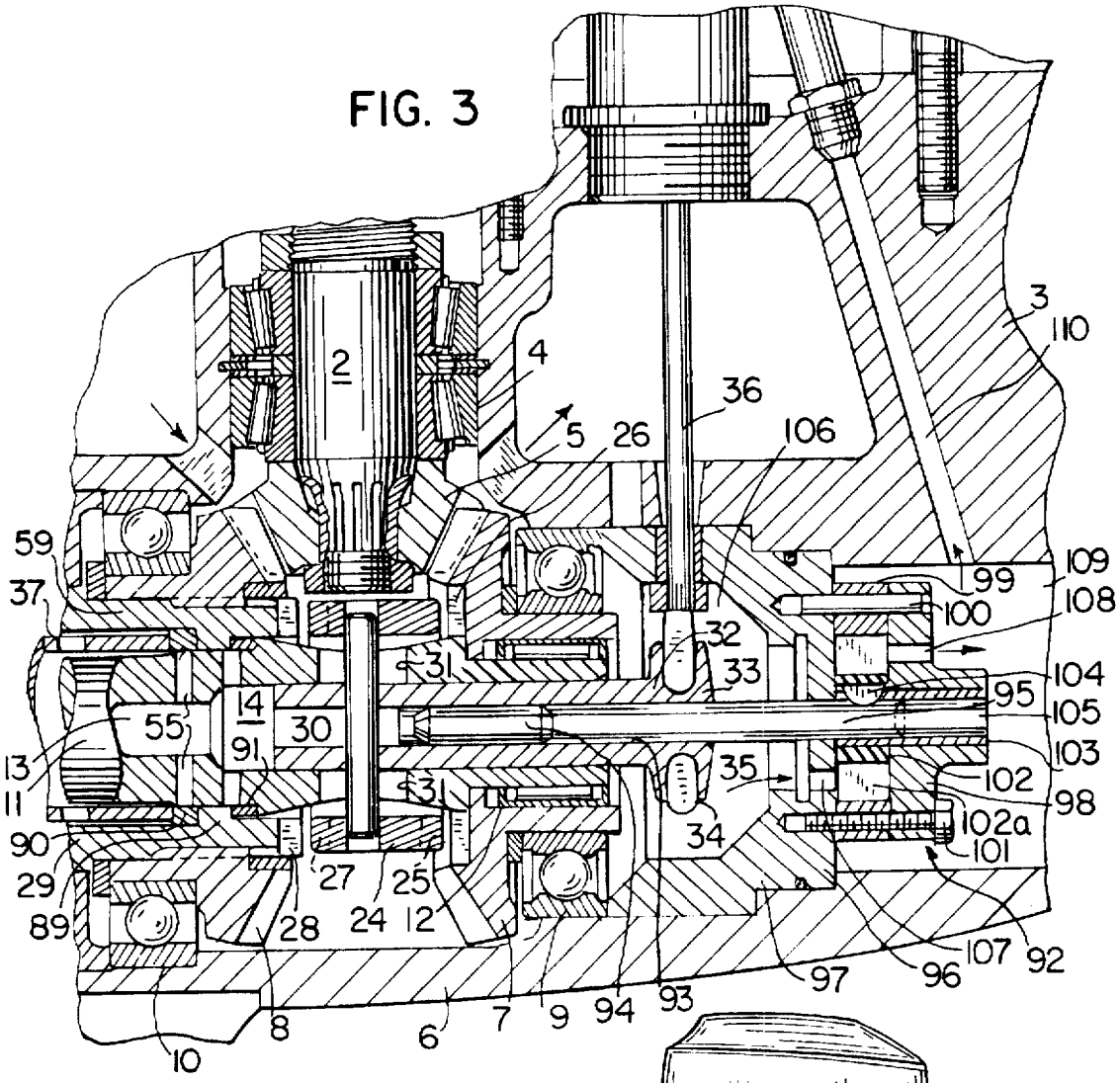
FIG. 1
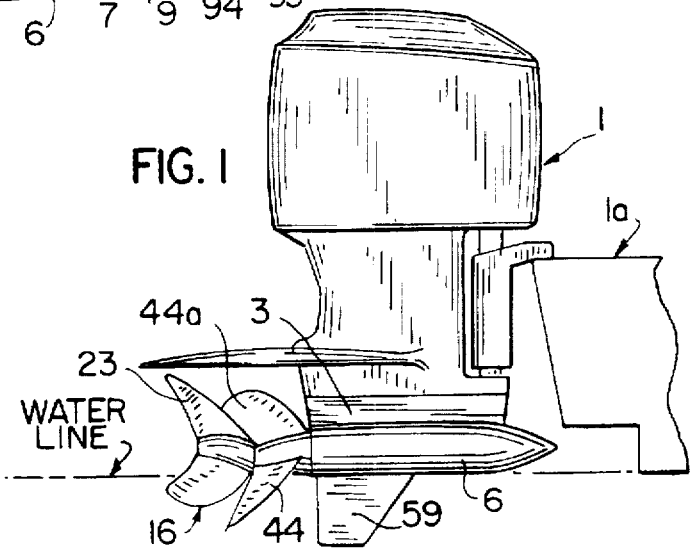
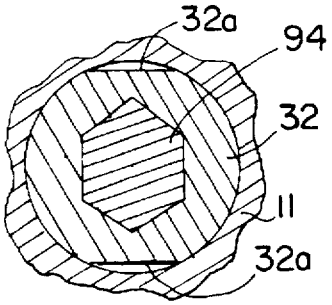
FIG.8

TWIN PROPELLER MARINE PROPULSION UNIT

BACKGROUND OF THE INVENTION

Some marine propulsion units, such as outboard drives and inboard/ outboard or stern drives, utilize a forward-neutral-reverse transmission, along with twin propellers. The typical twin propeller system includes a vertical drive shaft which is operably connected to the engine and is journaled for rotation in the lower gear case. The lower end of the drive shaft carries a pinion which drives a pair of coaxial bevel gears that are located in the lower torpedo-shaped section of the gearcase. Inner and outer propeller shafts are mounted concentrically in the lower section and each propeller shaft carries a propeller and the propeller of the outer shaft is located forwardly of the propeller of the inner shaft.

U.S. Pat. No. 4,793,773 describes a twin propeller propulsion system utilizing a sliding clutch mechanism having forward, neutral and reverse positions. When the clutch is moved in one direction to provide forward movement of the watercraft, the clutch acts to operably connect one of the bevel gears with the inner propeller shaft to thereby rotate the rear propeller and simultaneously connect the second bevel gear with the outer propeller shaft to thereby rotate the outer propeller shaft and the front propeller in the opposite direction. Thus, during forward movement of the watercraft both propellers are rotated at the same speed but in the opposite directions. In addition, the twin propeller system of the aforementioned patent also includes a mechanism to disconnect the outer propeller shaft when the clutch mechanism is moved in a second direction, so that the front propeller will not operate during the reverse movement of the watercraft.

SUMMARY OF THE INVENTION

The invention is directed to an improved twin propeller marine propulsion unit, such as an outboard drive or a stern drive, in which, in the forward mode of operation, only one of the propellers is driven at low engine speed and the second propeller is driven when the engine speed reaches a pre-selected elevated value.

In accordance with the invention, a vertical drive shaft is journaled within the lower gear case and the lower end of the drive shaft carries a beveled pinion gear that drives a pair of coaxial annular bevel gears that are located in the lower torpedo section of the gearcase. An inner propeller shaft is journaled within the lower section and extends through the aligned openings in the two bevel gears, while an outer propeller shaft is journaled concentrically around the inner shaft. Each propeller shaft carries a propeller with the propeller on the inner shaft being located to the rear of the propeller on the outer shaft.

A sliding clutch mechanism having forward, neutral and reverse positions is employed to selectively engage the inner propeller shaft with the bevel gears to thereby rotate the inner propeller shaft and the rear propeller in both forward and reverse modes. In addition, a hydraulically operated multiple disc clutch located in the lower torpedo section is employed to selectively cause engagement of one of the bevel gears with the outer propeller shaft when the engine speed reaches a pre-selected elevated value, normally in the range of about 3,000 to 6,000 rpm, to thereby cause the second or forward propeller to rotate in the opposite direction from the rear propeller. Thus, at low forward speeds only the rear propeller is driven, while at high forward speeds both propellers are driven.

The multiple disc clutch is moved to the engaged position at the pre-selected elevated engine speed by supplying pressurized fluid to a piston which engages the multiple clutch discs and moves the discs to a contacting or driving position. In a preferred form of the invention, the hydraulic fluid is pressurized through operation of a pump that is connected to the inner propeller shaft, so that rotation of the inner propeller shaft in the forward direction of boat movement will drive the pump to pressurize the hydraulic fluid. A valve mechanism is also incorporated in the hydraulic system and acts to supply pressurized fluid to the piston of the multiple disc clutch when the engine speed reaches the pre-selected elevated value. In this regard, a conventional speed sensor associated with the engine generates an electrical signal when the speed reaches the pre-selected value to thereby actuate the valve mechanism and deliver pressurized fluid to the piston of the multiple disc clutch. Movement of the piston will cause engagement of the multiple disc clutch to thereby operably connect the outer propeller shaft with one of the bevel gears to drive the forward propeller.

In the construction of the invention, only a single propeller is operable at low speeds. Thus during initial acceleration to get on plane, less blade area is in driving contact with the water which reduces the load on of the engine. Once the pre-selected elevated engine speed has been achieved, the second propeller is then driven, resulting in a significant improvement in acceleration of the watercraft when getting on plane.

In a preferred form of the invention, the marine propulsion unit utilizes full surfacing propellers, meaning that the water line at planing speed will be just below the lower torpedo section of the gear case or tangent to the lower surface of the torpedo section. This results in the elimination of torpedo drag, resulting in higher boat speeds with a given engine or a smaller engine for the same boat speed.

In the reverse mode of operation, the sliding clutch is moved in the opposite direction to provide engagement between the second bevel gear and the inner propeller shaft, thereby rotating the inner propeller shaft and the rear propeller in the opposite direction to cause reverse motion for the boat. The reverse rotation of the inner propeller shaft also drives the shaft of the hydraulic pump in the opposite direction, so that the pump will not operate to pressurize the hydraulic fluid, thereby preventing engagement of the multiple disc clutch and preventing rotation of the outer propeller shaft and forward propeller, even though the engine speed may exceed the pre-selected elevated value.

The construction of the invention also prevents engagement of the hydraulically operated multiple disc clutch in the event the sliding clutch is in the neutral position, and the engine speed is increased above the pre-selected elevated value. In the neutral position, the inner propeller shaft is not driven and thus the oil pump will not be driven, so that the hydraulic fluid will not be pressurized and the multiple disc clutch will not be engaged, even though the engine speed exceeds the pre-selected elevated value.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation of an outboard marine drive incorporating the invention;

FIG. 3 is an enlarged fragmentary longitudinal section of a portion of the lower drive unit;

FIG. 8 is an enlarged transverse section showing the oil passage in the sleeve that is mounted in the inner propeller shaft.

DESCRIPTION OF THE ILLUSTRATED EMBODIMENT

FIG. 1 shows a marine outboard engine 1 for a boat or watercraft 1*a* that incorporates the invention. It is contemplated, however, that the invention can also be utilized with an inboard/outboard, stern drive, or other marine drive.

Figure 2:
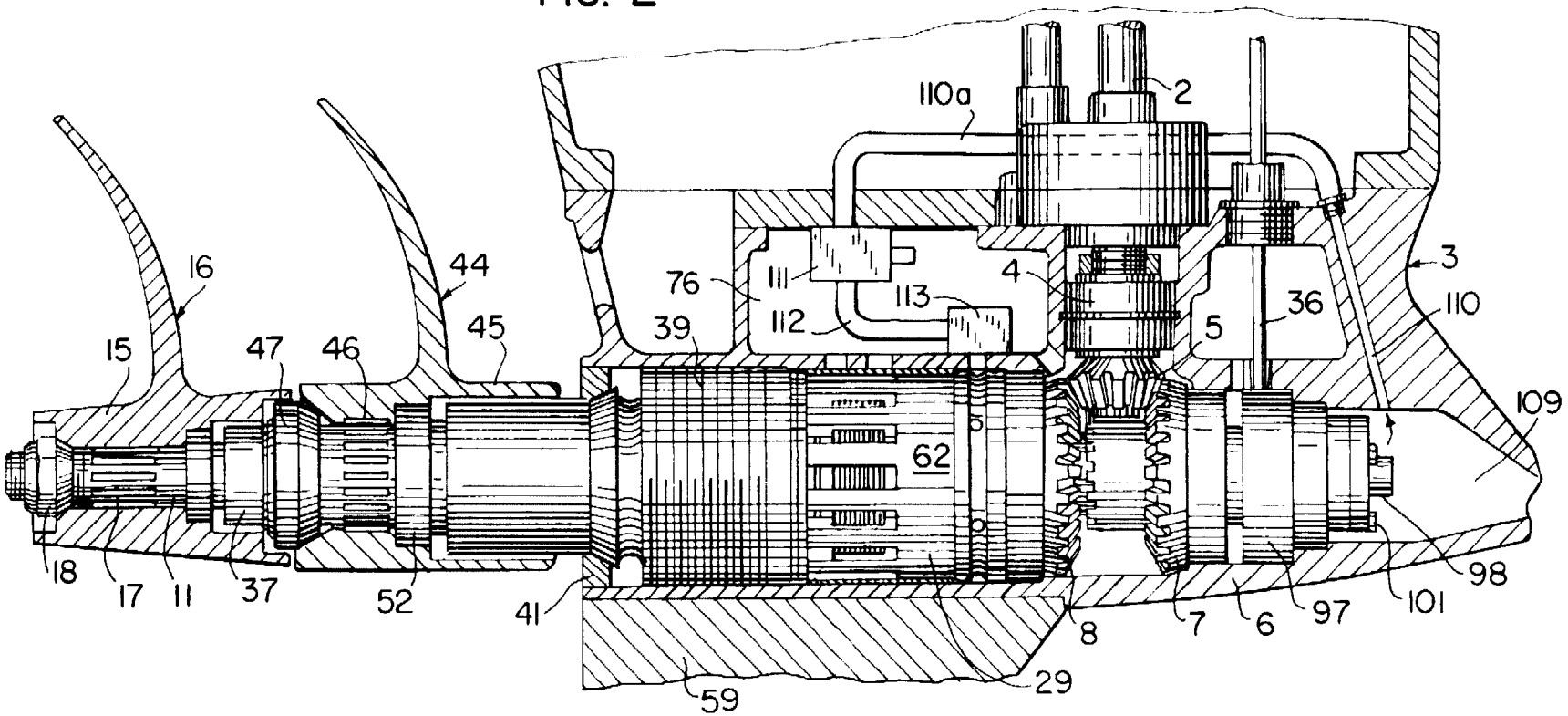
FIG. 2 is a longitudinal section of the lower drive unit.

As best shown in FIGS. 2 and 3, outboard engine 1 includes a vertical drive shaft 2 which is journaled for rotation in gear case 3 by a bearing assembly 4. The lower end of drive shaft 2 carries a beveled pinion gear 5 that is located within the lower torpedo-shaped section 6 of the gearcase.

Pinion gear 5 drives a pair of coaxial annular bevel gears 7 and 8. As best shown in FIG. 3, the hub portion of bevel gear 7 is journaled within torpedo section 6 by a bearing assembly 9, while the hub portion of bevel gear 8 is journaled within torpedo section 6 by bearing assembly 10. An inner propeller shaft 11 extends through the aligned openings in bevel gears 7 and 8, and the forward end of shaft 11 is journaled within the hub of bevel gear 7 by needle bearing assembly 12. The central portion of inner propeller shaft 11 is provided with an axial passage 13 which merges into an enlarged forward passage 14.

Figure 5:
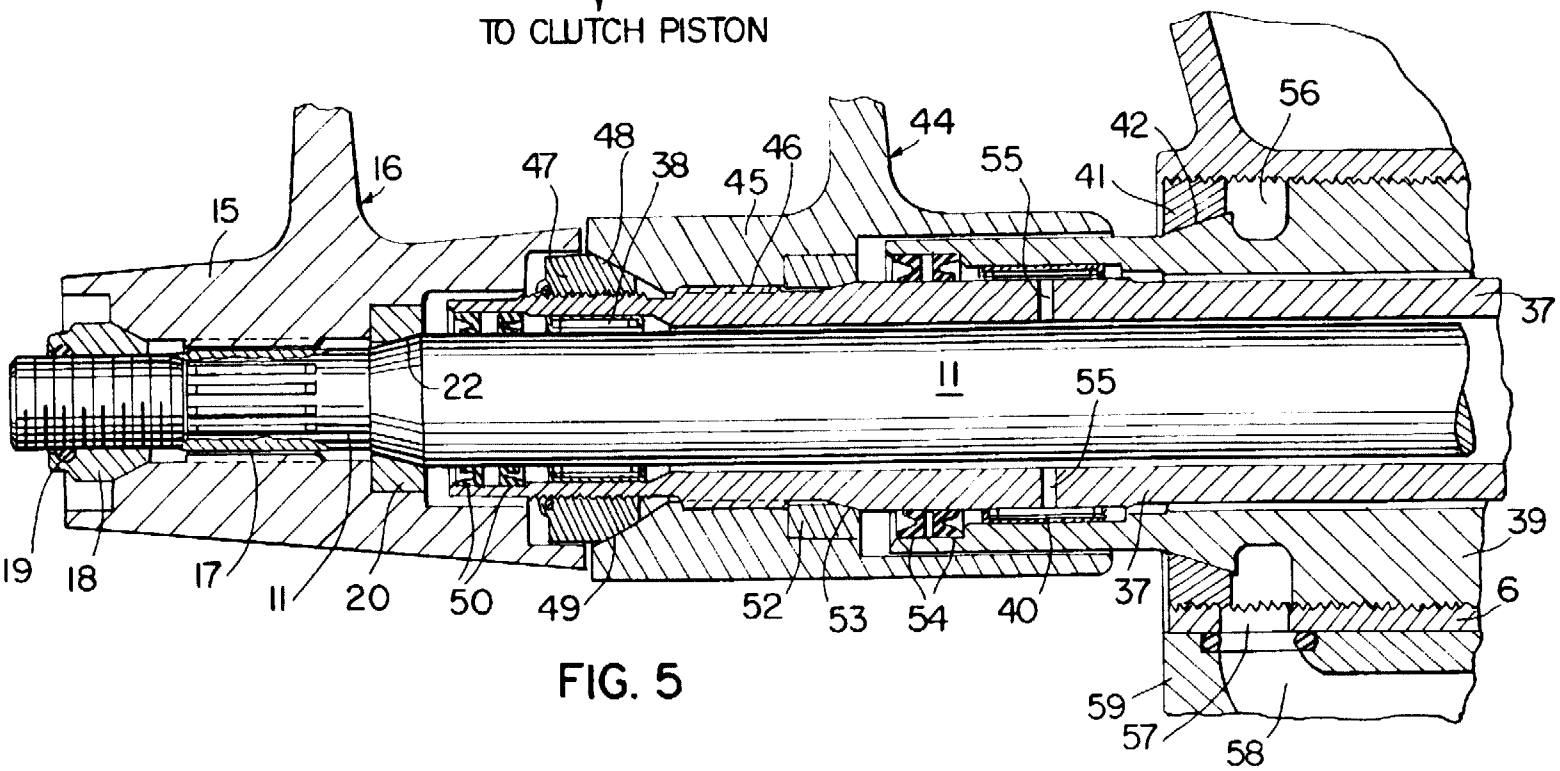
FIG. 5 is an enlarged fragmentary longitudinal section showing the attachment of the twin propellers to the propeller shafts.

The hub 15 of a propeller 16 is secured to the rear end of inner propeller shaft 11 through a spline 17. To retain propeller 16 on the end of shaft 11, a stop nut 18 is threaded on the end of the shaft and has a beveled inner surface which engages a corresponding beveled surface on the end of shaft 11, as seen in FIG. 5.

A thrust ring 20, preferably formed of a metal such as bronze, is press-fitted within a circumferential groove in hub 15, and is provided with a tapered inner surface that engages the tapered outer surface 22 of shaft 11. By press-fitting thrust ring 20 to hub 15, the ring will not accidentally be dislodged from the hub during replacement of the propeller 16.

As best shown in FIG. 1, propeller 16 includes a plurality of blades 23 which are located at a rearward rake angle of about 20° to 30°, and preferably about 25°.

An annular sliding clutch 24 is located within the torpedo section 6 and includes a series of forwardly facing teeth 25 which are adapted to engage teeth 26 on bevel gear 7. Clutch 24 is also formed with a series of rearwardly facing teeth 27, which are adapted to engage teeth 28 that are positioned on the forward end of cup-shaped housing 29 that is splined to the hub portion of bevel gear 8 and rotates with the bevel gear. Clutch 24 is adapted to be moved between three positions, namely a central or neutral position, a forward position where teeth 25 engage teeth 26 on bevel gear 7, and a rearward position in which the teeth 27 engage teeth 28 on housing 29.

To move the clutch between the three positions, a pin 30 extends diametrically across clutch 24 and extends through elongated slots 31 formed in the inner propeller shaft 11. Pin 30 also extends through a pair of aligned holes in a sleeve 32 that is mounted in the forward passage 14 of the inner propeller shaft 11. As best seen in FIG. 3, the forward end 33 of sleeve 32 is enlarged and is provided with a circumferential groove 34 that receives a crank 35 mounted on the lower end of actuating rod 36. Rotation of rod 36 will pivot crank 35 to thereby move sleeve 32 axially and thus move clutch 24 between the neutral, forward and rear positions. When clutch 24 is moved forwardly to engage teeth 25 with teeth 26 on bevel gear 7, the clutch will rotate with bevel gear 7 and impart rotation to the inner propeller shaft 11 to drive propeller 16.

An outer propeller shaft 37 is mounted concentrically around the inner propeller shaft 11 and the rear end portion of shaft 37 is journaled for rotation on inner shaft 11 by a bearing assembly 38.

To provide support for propeller shafts 11 and 37, an annular bearing carrier 39 is threaded within the rear end of torpedo section 6 and is positioned between the outer propeller shaft 37 and the torpedo section 6, as best shown in FIG. 5. Bearing assembly 40 is located between carrier 39 and outer propeller shaft 37, and serves to journal the shaft for rotation. A ring 41 is threaded in the rear end of torpedo section 6 and is provided with a tapered inner surface 42 that engages the tapered outer surface on carrier 39. By threading down the ring 41, the rear portion of the carrier 39 will be urged radially inward to provide support for the bearing 40.

A second propeller 44 is secured to the outer propeller shaft 37 and is located forwardly of propeller 16. Front propeller 44 includes a hub 45 that is connected to shaft 37 through spline 46. As in the case of propeller 16, propeller 44 includes a series of blades 44*a* each having a rearward rake of about 20° to 30°, and preferably about 25°. To retain propeller 44 on shaft 37, a stop nut 47 is threaded on the end of shaft 37 and is provided with a tapered surface 48 which engages a similarly tapered surface 49 on hub 45. In practice, forward propeller 44 can be a left hand screw, while rear propeller 16 can be a right hand screw.

A pair of annular seals 50 are located to the rear of bearing assembly 38 and serve to seal the space between shafts 11 and 37.

A ring 52 formed of bronze or the like, is press fitted in an internal circumferential recess in hub 45, and is provided with an internal tapered surface 53 which engages a similarly tapered surface on shaft 37. Ring 52 is located forwardly of spline 46, as best shown in FIG. 5. In addition, a pair of annular seals 54 are positioned in a recess in the end of carrier 39 and seal the space between the carrier and the outer propeller shaft 37.

Lubricating oil is adapted to fill the internal passages 13 and 14 of inner propeller shaft 11. Shaft 11 is provided with a series of radial holes 55 and the two forward groups of holes 55 are aligned with radial holes in the outer propeller shaft 37 so that lubricating oil can be delivered to bearing assemblies 38 and 40.

The annular space 56, best seen in FIG. 5, located forwardly of ring 41 constitutes a cooling water passage that communicates with an opening 57 in the lower portion of torpedo section 6. Opening 57, in turn, is in sealed communication with a water passage 58 in skeg 59. Cooling water drawn through an inlet in skeg 59 flows through passage 58 into passage 56 and then flows through internal passages in gearcase 3, not shown, to the water pump, which is driven by drive shaft 2. The water inlet arrangement in skeg 59 can be similar to that described in copending U.S. Pat. application Ser. No. 08/718,917, filed Sep. 25, 1996, and entitled Skeg Construction For A Marine Propeller Unit.

As previously noted, housing 29 includes a plurality of forwardly facing teeth 28 which are adapted to engage teeth 27 on clutch 24 when the clutch is moved rearwardly. The hub portion 60 of housing 29 is splined to bevel gear 8, as seen in FIG. 3, and rotates with the bevel gear. Housing 29 also includes an enlarged rear portion 62 that houses a multiple disc clutch 63. Clutch 63, when engaged, functions to connect the housing 29 with outer propeller shaft 37 to thereby drive propeller 44.

Figure 4:
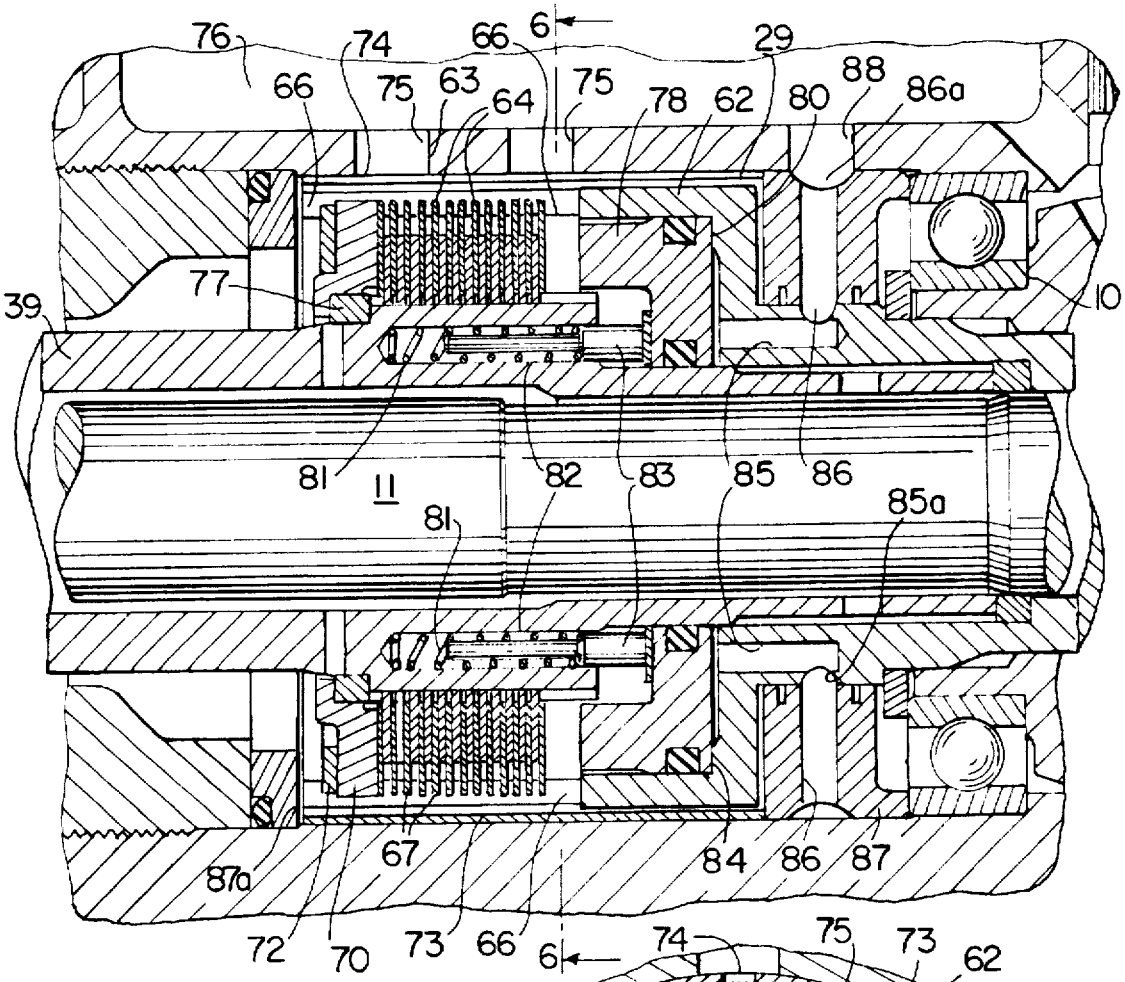
FIG. 4 is an enlarged fragmentary longitudinal section of a second portion of the drive unit showing the multiple disc clutch mechanism.
Figure 6:
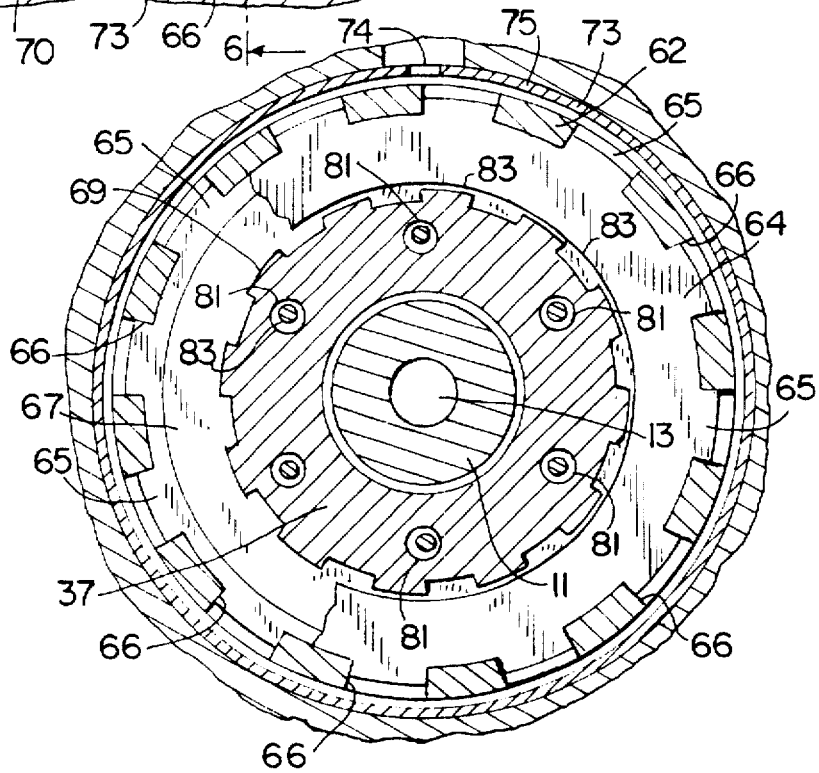
FIG. 6 is a section taken along line 6—6 of FIG. 4.

Clutch 63, as best shown in FIGS. 4 and 6, includes a series of clutch discs 64 each having a plurality of circumferentially spaced, outwardly extending ears or lugs 65, which are engaged with slots 66 formed in the enlarged rear portion 62 of housing 29. A second group of generally flat clutch discs 67 are interdigitated with discs 64 and opposite faces of the discs 67 are provided with a friction coating. Discs 67 are connected to the outer propeller shaft 37 through spline 69.

Discs 64 and 67 are contained within the enlarged rear portion 62 of housing 29 by an annular cap 70, having circumferentially spaced peripheral ears or lugs that engage the slot 66 in housing portion 62. The cap is retained in position by a snap ring 72.

Spaced outwardly of section 62 of housing 29 is a cylindrical metal sleeve 73 having a longitudinal slot 74 which registers with holes 75 in gearcase 3. Holes 75 communicate with an oil sump or reservoir 76 formed in the gearcase, as illustrated in FIG. 4. Oil can flow between reservoir 76 and torpedo section 6 through holes 75 and slot 74.

A thrust bearing 77 to take the reverse thrust of outer propeller shaft 37 is located to the rear of the clutch discs 64 and 67, and is mounted within an internal recess in cap 70.

Clutch discs 64 and 67 are moved into driving engagement by an annular piston 78 which is mounted in the enlarged section 62 of housing 29. Piston 78 has a rear face which is adapted to engage the discs 64 and 67, and is also provided with a forward face 80. Piston 78 is urged forwardly by a series of springs 81, as shown in FIG. 4, each of which is mounted within a longitudinal hole 82 in outer propeller shaft 37. The rear end of each spring 81 engages the bottom of hole 82 while the forward end of each spring bear against a shoulder on pin 83 which, in turn, bears against the piston 78., Thus, the force of springs 81 will urge the piston 78 forwardly. In this position the peripheral edge of forward face 80 will engage a shoulder 84 on housing 29, as seen in FIG. 4, to space face 80 away from the bottom of housing 29.

Piston 78 is adapted to be moved rearwardly to engage clutch discs 64 and 67 by a hydraulic system carried by gearcase 3. In this regard the rotating housing 29 is provided with a series of axial holes 85 which communicate with the space between piston face 80 and the bottom of housing 29. The forward ends of holes 85 connect with an annular groove 85*a* formed in the outer surface of hub portion 60 of housing 29, and groove 85*a* in turn communicates with radial holes 86 in ring 87. Ring 87 is fixed to gearcase 3 and is positioned between bearing assembly 9 and the forward end of sleeve 73. The outer ends of radial holes 86 communicate via a circumferential groove 86*a* with an opening 88 in gear case 3 which leads to control valve 113.

With this construction, pressurized oil from control valve 113 can be supplied through holes 86 and 85 to the housing 29 to thereby move piston 78 rearwardly and cause engagement of the disc clutch 63.

As illustrated in FIG. 3, the forward end of housing 29 is formed with a circumferential internal rib 89 and thrust bearings 90 and 91 located on either side of rib 89. Thrust bearing 90 is located between rib 89 and the forward end of the outer propeller shaft 37 and takes its forward thrust, while thrust bearing 91 is located forwardly of rib 89 and takes the rear thrust of inner propeller shaft 11.

As shown in FIG. 3, to pressurize the hydraulic fluid contained within the lower drive unit, a pump 92 is operably connected to inner propeller shaft 11. Sleeve 32 is provided with a central longitudinal opening 93 that has a hexagonal configuration, and the rear hexagonal-shaped end 94 of quill shaft 95 is received within the opening 93, so that rotation of sleeve 32 will be transmitted to quill shaft 95.

Pump 92 is a conventional gear pump of gerator type, including a generally flat rear wall 96 that is connected to a ring 97 having an opening to receive clutch rod 36. Pump 92 also includes a forward wall 98, and an eccentric spacer 99 is positioned between the rear wall 96 and the forward wall 98. The rear and forward walls 96 and 98, as well as spacer 99, are connected together by a plurality of dowels 100 along with a series of bolts 101. The space between the rear and forward walls 96 and 98 defines a pumping chamber, and a toothed inner rotor 102 and a toothed outer rotor 102*a* are mounted for rotation within the chamber. Inner rotor 102 is connected to the rear end of a sleeve 103 by a key 104, and the sleeve, in turn, is provided with an internal, hexagonal configuration which is engaged with the hexagonal section 105 of quill shaft 95. With this construction, rotation of clutch 24 and inner propeller shaft 11 will rotate sleeve 32 and quill shaft 95 to thereby drive pump 92.

The chamber 106 located at the forward portion of the torpedo section 6 of the gearcase is normally filled with oil and during operation of pump 92 oil will be drawn from chamber 106 through inlet 107 to the pump, and pressurized fluid will be discharged from the pump through outlet 108 to the forward chamber 109. The pressurized fluid will then flow through passage 110 and line 110*a* to pressure regulator 111.

Figure 7:
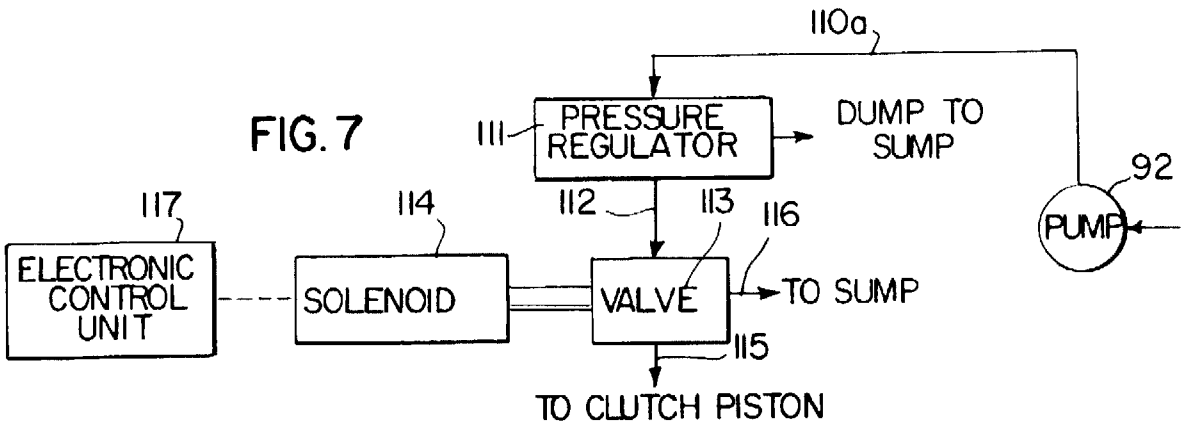
FIG. 7 is a schematic view showing the hydraulic system for operating the clutch.

The mechanism for supplying pressurized hydraulic fluid or oil to the multiple disc clutch 63 is shown schematically in FIG. 7. Line 110*a* containing the pressurized fluid is connected to a conventional pressure regulator 111 which, in practice, would discharge fluid at a pressure of about 200 psi, through line 112 to a two-position valve 113 operated by solenoid 114. Valve 113 has one outlet line 115 connected to opening 88 and a second outlet line 116 connected to reservoir 76.

Solenoid 114 is energized by an electronic control unit 117 that senses the engine speed. The electronic control unit can be a type that is operably connected to a toothed gear on the engine crankshaft by a magnetic pick-up that will sense the presence of the teeth as the gear rotates. At idle and low speeds, disc clutch 63 will not be engaged. When the engine speed increases to an elevated pre-selected value, generally in the range of about 3,000 to 6,000 rpm, the control unit will cause pressurized hydraulic fluid entering the valve 113 through line 112, to flow through outlet line 115 causing engagement of clutch 63 to drive the outer shaft 37 and propeller 44.

As shown in FIG. 8, sleeve 32 has a pair of diametrically opposed flats 32*a* that define oil passages for the flow of oil through inner shaft 11 from chamber 106.

It has been found that with a V-bottom boat, the least drag from the boat hull is achieved at a running angle of about 2½°to 4½°depending on the dead rise angle of the V-bottom. However, in practice, it has been noted that these running angles are not normally obtainable because the boat will begin to "porpoise" at lower running angles. Thus, "porpoising" of the boat occurs at less than the best running angle.

Studies and testing have shown that when considering a propeller alone, without interaction with a boat or watercraft, a 0° propeller rake is most efficient. However, when the propeller is interacted with a boat, a rearward rake of about 15° to 20° has been found to be most beneficial for all-around performance, and a higher rake, above 20°, has been found to be less efficient. Through the invention, it has been found that utilizing a higher rake of above 20°, and preferably about 25°, with full surfacing counter-rotating propellers in which the water line is below the torpedo section, produces certain unexpected advantages. More specifically, the high rearward rake will act to dampen "porpoising" of the boat at high speeds, to thereby permit running at a more favorable running angle, to reduce boat drag. Secondly, the high rake produces a downward component of force on the propeller blades which aids in lifting the bow of the boat to reduce drag.

OPERATION

FIG. 3 shows the clutch 24 in the neutral position. To move the watercraft or boat forwardly, clutch actuating rod 36 is rotated causing the crank 35 to move the sleeve 32 and clutch 24 forwardly, or to the right as shown in FIG. 3, to cause engagement of clutch teeth 25 with teeth 26 on bevel gear 7. This results in the rotation of bevel gear 7 being transmitted to the inner propeller shaft 11 to drive the propeller 16.

At idle speed, as well as low speeds below the pre-selected high speed of about 3000 to 6000 rpm, pump 92 will operate to deliver the fluid to valve 113, but at this time the valve will be in a first position, such that fluid will be merely dumped from the valve to the sump or reservoir 76 through line 116 and will not be delivered to the multi-disc clutch 63. Thus, at idle and low speeds only the inner propeller shaft 11 and propeller 16 will be driven.

When the engine speed reaches the pre-selected elevated value, the electronic control unit 117 will cause the solenoid operated valve 113 to deliver pressurized fluid to clutch 63, as previously described, to provide driving engagement between the rotating housing 29 and the outer propeller shaft 37. Thus, both propellers 16 and 44 will operate in opposite directions and at the same speed. On slowing down from high speed, both propellers will continue to operate at reduced engine rpm down to a second preselected value, generally in the range of about 1,400 to 1,800 rpm. The electronic control unit 117 will then cause solenoid operated valve 113 to dump pressurized fluid from clutch 63 to reservoir 76. This permits the springs 81 to move clutch 63 to the disengaged position to discontinue the drive of the outer propeller shaft 37 and propeller 44.

In reverse operation of the watercraft, clutch 24 is moved to the left, as shown in FIG. 3, through rotation of rod 36, causing clutch teeth 27 to engage the teeth 28 on housing 29. As housing 29 is splined to bevel gear 8, clutch 24 along with the inner propeller shaft 11 will rotate in the opposite direction to move the watercraft in reverse. At this time, the forward propeller 44 will free wheel. If the engine speed is increased above the pre-selected value of about 3,000 to 6,000 rpm while the clutch 24 is in the reverse position, the solenoid operated valve 113 will be moved to the second position, connecting valve outlet line 116 with clutch 63, but as the pump shaft 95 is rotating in the opposite direction, the pump 92 will not operate to pressurize the hydraulic fluid, so that the multiple disc clutch 63 will not be engaged even at high speed.

If the clutch 24 is in the neutral position, and the engine is revved to high speed, above the pre-selected value, the electronic control unit 117 will cause the solenoid operated valve 113 to be moved to the second position connecting valve outlet line 116 with clutch 93, but in the neutral position of clutch 24, pump shaft 95 will not be rotated, so that the pump 92 will not be operated to pressurize the fluid. Thus, even if the engine speed is increased to above the pre-selected value, when clutch 24 is in neutral, clutch 63 will not be engaged and the outer propeller shaft 37 along with propeller 44 will not be operated.

With the construction of the invention, using sequential shifting, only a single propeller is operated at off plane boat speeds. This increases propeller slip and reduces boat speed when off-plane. Reduced boat speed facilitates docking. The second propeller is engaged when engine speed reaches a pre-selected elevated value to provide an improvement in acceleration. The side forces of the counter-rotating, cleaver-type propellers are balanced out, resulting in positive tracking, minimal steering torque as well as virtually eliminating chine walk.

As a further advantage, the multiple disc clutch 63 is operated through pressurized hydraulic fluid which is pressurized by the pump 92 driven by the inner propeller shaft 11. The multiple disc clutch has the advantage of gradually taking up the load as it is engaged during high speed operation of the engine.

As the marine propeller unit can be a full surfacing type, in which the water line is slightly beneath the lower surface of the torpedo section 6 when the boat is on plane, torpedo drag is eliminated and a substantial improvement in boat speed, and fuel economy is achieved.

While the above description has shown the invention as used with full surfacing propellers, it is contemplated that the invention can also be used with submerged propellers.

We claim:

1. A marine propulsion unit, comprising a marine engine, a housing, a first propeller shaft journaled for rotation in the housing, a first propeller secured to said first propeller shaft, a second propeller shaft journaled for rotation in said housing and disposed concentrically of said first propeller shaft, a second propeller mounted on said second propeller shaft and disposed axially of said first propeller, first means for operably connecting said engine to said first propeller shaft to thereby drive said first propeller, and second means responsive to a first elevated engine speed substantially above idle speed for operably connecting said second propeller shaft to said engine to thereby drive said second propeller in conjunction with said first propeller.

2. The unit of claim 1, wherein said first means comprises, a drive shaft journaled in the housing, first bevel gear means connected to said drive shaft, and first clutch means having an engaged position where said first clutch means effects engagement of said first bevel gear means with said first propeller shaft and having a disengaged position.

3. The unit of claim 2, wherein said second means comprises second bevel gear means operably connected to said drive shaft and located coaxially with said first bevel gear means, and second clutch means having an engaged position wherein said second clutch means operably connects said second bevel gear means and said second propeller shaft, said second clutch means also having a disengaged position, and speed sensing means responsive to said first elevated engine speed for moving said second clutch means from said disengaged position to said engaged position to thereby operate said second propeller in conjunction with said first propeller.

4. The unit of claim 1, and including means responsive to a second engine speed less than said first engine speed and above said idle speed for disconnecting said engine from said second propeller shaft.

5. The unit of claim 2, wherein said first clutch means is slidable relative to said first propeller shaft between the engaged and disengaged positions, said first clutch means being rotatably fixed to said first propeller shaft, said first clutch means having a series of clutch teeth, said first bevel gear means having a series of teeth disposed to engage the clutch teeth to thereby provide a driving connection between said first bevel gear means and said first propeller shaft.

6. The unit of claim 3, wherein said second clutch means comprises a plurality of first generally flat clutch discs and a plurality of second generally flat clutch discs interdigitated with said first discs, said first discs being operably connected to said second bevel gear means and said second discs being operably connected to said second propeller shaft, and pressure means for pressing said first and second clutch discs into flatwise driving engagement to thereby operably connect said second bevel gear means with said second propeller shaft.

7. The unit of claim 6, wherein said first and second clutch discs are annular in shape and disposed around said second propeller shaft, said pressure means comprising an annular piston having a first surface engaged with said clutch discs and having a second surface, and means for exerting a force against said second surface to move said clutch discs into driving engagement.

8. The unit of claim 7, wherein said means for exerting a force comprises a hydraulic system carried by the housing and including a hydraulic fluid, means for pressurizing the hydraulic fluid, and valve means responsive to said first elevated engine speed for directing pressurized hydraulic fluid into contact with the second surface of said piston.

9. The unit of claim 8, wherein said pressurizing means comprises a hydraulic pump disposed in said housing and connected in said hydraulic system.

10. The unit of claim 9, wherein said pump includes a pump shaft, and connecting means for operably connecting said pump shaft to said first propeller shaft, whereby rotation of said first propeller shaft will operate said pump.

11. A marine propulsion unit, comprising a housing, a vertical drive shaft journaled in said housing and operably connected to an engine, an inner generally horizontal propeller shaft journaled for rotation relative to said housing, a first propeller connected to said inner propeller shaft, an outer generally horizontal propeller shaft journaled for rotation relative to said housing and disposed concentrically outward of said inner propeller shaft, a second propeller connected to said outer propeller shaft and disposed axially forward of said first propeller, a first bevel gear operably connected to said drive shaft, first clutch means for selectively connecting said first bevel gear to said inner propeller shaft to thereby drive said inner propeller shaft and said first propeller in accordance with rotation of said first bevel gear, a second bevel gear operably connected to said drive shaft and mounted coaxially with said first bevel gear, second clutch means for selectively engaging said second bevel gear with said outer propeller shaft to thereby drive said outer propeller shaft and said second propeller in accordance with rotation of said second bevel gear, said second clutch means being operable separately from said first clutch means, and means responsive to a first elevated engine speed substantially higher than idle speed for operating said second clutch means to thereby operably connect said second bevel gear with said second propeller shaft.

12. The unit of claim 11, wherein said second clutch means comprises a multiple disc clutch having a first plurality of clutch elements operably connected to said second bevel gear and having a second plurality of clutch elements interdigitated with said first elements and operably connected to said second propeller shaft.

13. The unit of claim 12, wherein said second clutch means also includes pressure means having a first surface disposed to contact said first and second clutch elements and having a second surface, and means for directing a pressurized hydraulic fluid against said second surface to thereby force said interdigitated clutch elements into driving engagement.

14. The unit of claim 11, and including means responsive to a second engine speed less than said first speed and above said idle speed for moving said second clutch means to a disengaged position to disengage the connection between said second bevel gear and said second propeller shaft.

15. The unit of claim 11, wherein said housing comprises a gearcase and a torpedo-shaped lower section, said lower section including a generally bullet-shaped forward end and a rear end, an annular bearing carrier disposed in the rear end of said lower section and located radially outward of said outer propeller shaft, and first bearing means supported by the carrier for journaling the outer propeller shaft for rotation.

16. The unit of claim 15, wherein said carrier is provided with a tapered outer surface spaced radially inward from said lower section to provide a space therebetween, a ring disposed in said space and having a tapered inner surface to engage the tapered outer surface of said carrier, and means for threadedly connecting said ring to said lower section whereby threading of said ring in said lower section will urge said first bearing means into engagement with said outer propeller section.

17. The unit of claim 15, and including second bearing means for journaling the inner propeller shaft in said outer propeller shaft.

18. A marine propulsion unit, comprising a housing, a vertical drive shaft journaled in said housing, a beveled pinion gear carried by the drive shaft, a first annular bevel gear operably engaged with said pinion gear, a second bevel gear axially aligned with said first bevel gear and operably connected to said pinion gear, an inner propeller shaft disposed axially within said annular bevel gears and journaled for rotation relative to said housing, a first propeller secured to an end of said inner propeller shaft, an outer propeller shaft disposed concentrically outward of said first propeller shaft and journaled relative thereto, a second propeller connected to said outer propeller shaft and located axially forward of said first propeller, said first bevel gear including a plurality of axially facing teeth, a clutch slidably mounted relative to said inner propeller shaft and rotatably fixed to said inner propeller shaft, said clutch having a neutral position and an engaged position and having a plurality of clutch teeth, means for moving said clutch axially between said neutral and engaged position, said clutch teeth being engaged with the axially facing teeth of said bevel gear when the clutch is in the engaged position to thereby cause rotation of the inner propeller shaft and said first propeller, an annular clutch housing operably connected to said second bevel gear and rotatable therewith, said clutch housing being disposed concentrically outward of said outer propeller shaft, a second clutch disposed within said clutch housing and including a plurality of first clutch discs and a plurality of second clutch discs interdigitated with said first discs, said first clutch discs being slidable longitudinally relative to said clutch housing and being rotatable therewith, said second clutch disc being slidable longitudinally relative to said outer propeller shaft and being rotatable therewith, pressure means disposed within said clutch housing and having a first surface disposed to engage said clutch discs and having an opposite second surface, and hydraulic means for directing a pressurized hydraulic fluid against said second surface to move said clutch discs into driving engagement to thereby drive said outer propeller shaft and said second propeller in the opposite direction from said first propeller.

19. The unit of claim 18, wherein said hydraulic means comprises a hydraulic system carried by said housing and including a hydraulic fluid, pumping means in said hydraulic system to pressurize said hydraulic fluid, and valve means for directing pressurized hydraulic fluid into contact with the second face of said pressure means.

20. The unit of claim 19, wherein said pumping means includes a pump shaft, and connecting means for connecting the pump shaft to said inner propeller shaft whereby said pump shaft will rotate in accordance with rotation of said inner propeller shaft.

21. The unit of claim 20, wherein said pump shaft is aligned with the axis of said inner propeller shaft.

22. The unit of claim 19, and including means responsive to an elevated engine speed substantially above idle speed for operating said valve means to thereby deliver pressurized hydraulic fluid to said second clutch.

23. The unit of claim 18, and including biasing means operably connected to said pressure means for urging said pressure means in a direction away from said interdigitated clutch discs.

24. A marine propulsion unit, comprising, a marine engine, a housing, an inner generally horizontal propeller shaft journaled for rotation relative to said housing, a first propeller connected to said inner propeller shaft, an outer generally horizontal propeller shaft journaled for rotation relative to said housing and disposed concentrically outward of said inner propeller shaft, a second propeller connected to said outer propeller shaft and disposed axially forward of said first propeller, first clutch means for operably connecting said engine to said inner propeller shaft to thereby drive said inner propeller shaft and said first propeller, and second hydraulically operated clutch means for operably engaging said engine with said outer propeller shaft to thereby drive said outer propeller shaft and said second propeller.

25. The unit of claim 24, and including a hydraulic system disposed in said housing and containing a hydraulic fluid, means in said system for pressurizing said fluid, valve means for supplying pressurized fluid to said second hydraulically operated clutch means to effect engagement of the second clutch means and operably connect said outer propeller shaft with said engine to drive said second propeller, and engine speed sensing means operably connected to said valve means to actuate the valve means and supply fluid to said second clutch means when the engine speed exceeds a predetermined elevated value substantially above idle speed.

26. A watercraft construction, comprising a watercraft to move on a body of water, a marine propulsion unit mounted on the watercraft and including an engine and having a lower housing, said lower housing including a generally torpedo-shaped lower section, a pair of concentric propeller shafts each mounted for rotation relative to said lower section, a propeller carried by each propeller shaft with said propellers being located axially of each other, said propeller shafts being operably connected to said engine in a manner to rotate the propeller shafts and the respective propellers in opposite directions to drive the watercraft in a forward direction, the blades of each propeller having a rearward rake in the range of 20° to 30°, said propulsion unit being mounted relative to said watercraft such that the water line at a planing speed of said watercraft is adjacent the bottom surface of said lower section.

27. The watercraft construction of claim 26, wherein only a minor portion of the diameter of the propeller blades of each propeller are located beneath the water level when said watercraft is at said planing speed.

28. The watercraft construction of claim 27, wherein the water line at said planing speed is slightly below the bottom surface of said lower section.

29. A watercraft construction, comprising a watercraft to move on a body of water, a marine propulsion unit mounted on the watercraft and including an engine and having a lower housing, said lower housing including a generally torpedo-shaped lower section, a pair of concentric propeller shafts each mounted for rotation relative to said lower section, a first of said propeller shafts disposed radially outward of a second of said propeller shafts, a propeller carried by each propeller shaft with said propellers being located axially of each other, said propeller shafts being operably connected to said engine in a manner to rotate the propeller shafts and the respective propellers in opposite directions to drive the watercraft in a forward direction, an annular bearing carrier disposed in a rear portion of said lower section and located radially outward of said first propeller shaft, bearing means supported by the carrier for journaling the first propeller shaft for rotation, said carrier being provided with a tapered outer surface spaced radially inward from said lower section to provide a space therebetween, a ring disposed in said space and having a tapered inner surface to engage the tapered outer surface of said carrier, and means for threadedly connecting said ring to said lower section whereby threading of said ring in said lower section will urge said first bearing means into engagement with said first propeller shaft.

30. A marine propulsion unit, comprising a housing, a vertical drive shaft journaled in said housing, a beveled pinion gear carried by said drive shaft, a first annular bevel gear operably connected with said pinion gear, a second bevel gear axially aligned with said first bevel gear and operably connected to said pinion gear, an inner propeller shaft disposed axially within said annular bevel gears and journaled for rotation relative to said housing, a first propeller secured to an end of said inner propeller shaft, an outer propeller shaft disposed concentrically outward of said first propeller shaft and journaled relative thereto, a second propeller connected to said outer propeller shaft and located axially forward of said first propeller, said first and second bevel gears each including a plurality of axially facing teeth, a first clutch slidably mounted relative to said inner propeller shaft and rotatably fixed to said inner propeller shaft, each end of said first clutch having a plurality of axial clutch teeth, means for moving said first clutch axially between a forward position where the clutch teeth on one end of the clutch are engaged with the axial teeth on said first bevel gear and a reverse position where the clutch teeth on the opposite end of said clutch are engaged with the axial teeth on the second bevel gear and a neutral position, said clutch when in the forward position effecting rotation of the inner propeller shaft and said first propeller, an annular clutch housing operably connected to said second bevel gear and rotatable therewith, said clutch housing being disposed concentrically outward of said outer propeller shaft, a hydraulically operated second clutch disposed in said clutch housing, pressure means located in said clutch housing and operably connected to said second clutch for moving said second clutch from a disengaged position to an engaged position, hydraulic means for directing pressurized hydraulic fluid to the pressure means to move said second clutch to the engaged position and thereby drive said outer propeller shaft and said second propeller in the opposite direction from said first propeller, said hydraulic means including pumping means to pressurize said hydraulic fluid, said pumping means being constructed and arranged to deliver pressurized fluid to said pressure member when said first clutch is in said forward position and to prevent delivery of pressurized fluid to said second clutch when said first clutch is in said reverse position.

31. The unit of claim 30, wherein said pumping means includes a pump operably connected to said inner propeller shaft and rotatable therewith.

* * * * *